US009074603B2

(12) United States Patent
Wu

(10) Patent No.: US 9,074,603 B2
(45) Date of Patent: Jul. 7, 2015

(54) COOLING FAN WITH CIRCUIT BOARD POSITIONING STRUCTURE AND AN ASSEMBLY METHOD THEREOF

(75) Inventor: Ching-Lin Wu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 340 days.

(21) Appl. No.: 13/543,949

(22) Filed: Jul. 9, 2012

(65) Prior Publication Data

US 2013/0064700 A1 Mar. 14, 2013

(30) Foreign Application Priority Data

Sep. 9, 2011 (TW) ..... 100132743 A

(51) Int. Cl.

| | |
|---|---|
| ***F04D 25/06*** | (2006.01) |
| ***F04D 29/06*** | (2006.01) |
| ***F04D 17/16*** | (2006.01) |
| ***F04D 29/42*** | (2006.01) |
| ***F04D 29/60*** | (2006.01) |

(52) U.S. Cl.

CPC ..... *F04D 17/16* (2013.01); *Y10T 29/49009* (2015.01); *F04D 29/4226* (2013.01); *F04D 29/601* (2013.01); *F04D 25/0693* (2013.01); *F04D 25/0633* (2013.01); *F04D 25/0646* (2013.01)

(58) Field of Classification Search

CPC ..... F04D 1/006; F04D 17/08; F04D 25/02; F04D 25/06; F04D 25/0606; F04D 25/0613; F04D 25/0633; F04D 25/064; F04D 25/0646; F04D 25/0693

USPC ..... 417/352, 353, 354

See application file for complete search history.

(56) References Cited

U.S. PATENT DOCUMENTS

| | | | | |
|---|---|---|---|---|
| 6,050,785 | A * | 4/2000 | Horng | 417/354 |
| RE37,261 | E * | 7/2001 | Schmider et al. | 417/423.7 |
| 8,192,157 | B2 | 6/2012 | Horng | |
| 2003/0063976 | A1 * | 4/2003 | Horng et al. | 416/183 |
| 2004/0257774 | A1 * | 12/2004 | Lin | 361/719 |
| 2006/0138878 | A1 * | 6/2006 | Hoffman et al. | 310/43 |
| 2007/0217149 | A1 * | 9/2007 | Horng et al. | 361/695 |
| 2007/0231163 | A1 * | 10/2007 | Liu | 417/354 |
| 2008/0259240 | A1 * | 10/2008 | Song et al. | 349/62 |
| 2009/0155097 | A1 * | 6/2009 | Winkler | 417/354 |

FOREIGN PATENT DOCUMENTS

| | | |
|---|---|---|
| TW | 449072 U | 8/2001 |
| TW | I237938 B | 8/2005 |
| TW | M387164 | 8/2010 |

* cited by examiner

*Primary Examiner* — Charles Freay
*Assistant Examiner* — Timothy P Solak
(74) *Attorney, Agent, or Firm* — Alan D. Kamrath; Kamrath IP Lawfirm, P.A.

(57) ABSTRACT

A cooling fan includes a fan frame, a circuit board, a stator-coil unit and an impeller. The fan frame includes a metal seat and a lateral wall. The metal seat includes an engaging face and an engaging portion arranged on the engaging face. The lateral wall is arranged on a periphery of the metal seat and includes an air inlet and an air outlet. The circuit board includes a positioning hole. The circuit board is press fit around the engaging portion of the metal seat via the positioning hole and adhered to the engaging face of the metal seat. The circuit board includes an insulation layer facing the metal seat. The stator-coil unit is mounted on the metal seat of the fan frame and electrically connected to the circuit board. The impeller is rotatably coupled with the stator-coil unit.

32 Claims, 8 Drawing Sheets

COOLING FAN WITH CIRCUIT BOARD POSITIONING STRUCTURE AND AN ASSEMBLY METHOD THEREOF

BACKGROUND OF THE INVENTION

1. Field of the Invention

The present invention generally relates to a cooling fan and an assembly method thereof and, more particularly, to a cooling fan having a metal seat and a circuit board easily mounted on the metal seat while insulation between the circuit board and the metal seat is ensured, as well as to an assembly method of the cooling fan.

2. Description of the Related Art

FIG. 1 shows an engagement structure of a stator unit of a cooling fan disclosed in Taiwan Patent No. M387164. The cooling fan 8 includes a housing 81, a stator unit 82 and a blade unit 83. The housing 81 forms a seat 811 and a shaft tube 812 by integral injection. The seat 811 has a plurality of first engaging portions 813. The stator unit 82 has a stator 821 consisting of a plurality of stacked coils and silicon steel plates. The stator 821 is coupled with a circuit board 822 and includes a plurality of second engaging portions 823.

In assembly, the circuit board 822 is coupled to the bottom face of the stator 821 by forcing the second engaging portions 823 of the stator 821 through the holes of the circuit board 822. The stator 821 is then mounted on the seat 811 by forcing the shaft tube 812 through the circuit board 822 and the stator 821. Next, the first engaging portions 813 and the second engaging portions 823 are engaged with each other. Finally, the blade unit 83 is coupled with the shaft tube 812 to complete the assembly procedure of the cooling fan 8.

However, the height of the cooling fan 8 cannot be reduced due to the arrangements of the first engaging portions 813 and the second engaging portions 823. As a result, it is difficult to miniaturize the cooling fan 8. Furthermore, it is inconvenient to assemble the cooling fan 8 due to the steps of coupling the circuit board 822 with the stator unit 82 and engaging the second engaging portions 823 with the first engaging portions 813. Moreover, the first engaging portions 813 or the second engaging portions 823 could break during the assembly procedure, affecting the engagement between the seat 811 and the stator unit 82. Still further, since the housing 81 is made of plastic, certain parts of the seat 811 (such as ribs) are fragile. Consequently, the structural strength of the cooling fan 8 is low, and the quality of the cooling fan 8 is poor.

To solve the problem, Taiwan Patent No. 1353509 discloses a fan casing structure as shown in FIG. 2. The fan casing 9 includes a support board 91. The support board 91 includes a bottom plate 911 and a shaft tube portion 912 located at the center of the bottom plate 911. The support board 91 may be mounted with certain components, such as a stator unit, a blade unit or the like, to construct a cooling fan.

Although the bottom plate 911 of the fan casing 9 has higher strength and quality, it is still inconvenient to assemble a cooling fan using the fan casing 9 and is still difficult to reduce the height of the cooling fan, as it is the case of the cooling fan 8. This is because it is inconvenient to form the stator unit by assembling the silicon steel plates, the coils and the circuit board before the stator unit can be installed in the fan casing 9 (the coils and the circuit board are essential components to the stator unit, as can be readily appreciated by one skilled in the art). More importantly, it is also difficult to ensure satisfactory insulation between the circuit board and the bottom plate 911, since the bottom plate 911 is made of metal.

SUMMARY OF THE INVENTION

It is therefore the objective of this invention to provide a method of assembly directed to assembly of a cooling fan. The method of assembly allows the stator-coil unit to be installed after assembly of the circuit board, simplifying the assembly procedure of the cooling fan.

It is another objective of this invention to provide a method of assembly directed to assembly of a cooling fan. The method of assembly allows easy arrangement of the enameled copper wire of the circuit board as well as easy positioning of the circuit board.

It is yet another objective of this invention to provide a cooling fan with satisfactory insulation between the metal seat and the circuit board when the circuit board is adhered to the metal seat.

It is yet another objective of this invention to provide a cooling fan with a reduced height by adhesion of the circuit board to the metal seat.

It is yet another objective of this invention to provide a cooling fan with convenient assembly by arrangement of an insulation layer between the circuit board and the metal seat. The insulation layer is in the form of a film with adhesion and insulation functions.

A cooling fan including a fan frame, a circuit board, a stator-coil unit and an impeller is disclosed in an embodiment of the invention. The fan frame includes a metal seat and a lateral wall. The metal seat comprises an engaging face and an engaging portion arranged on the engaging face. The lateral wall is arranged on a periphery of the metal seat and defines an air inlet and an air outlet. The circuit board includes a positioning hole. The circuit board is press fit around the engaging portion of the metal seat via the positioning hole and adhered to the engaging face of the metal seat. The circuit board includes an insulation layer facing the metal seat. The stator-coil unit is mounted on the metal seat of the fan frame and electrically connected to the circuit board. The impeller is rotatably coupled with the stator-coil unit.

In a preferred form shown, the engaging portion has one end protruding from the engaging face of the metal seat. The end of the engaging portion is adapted to be coupled with the stator-coil unit.

In the preferred form shown, the end of the engaging portion extends through the positioning hole of the circuit board. The end of the engaging portion protrudes from the circuit board.

In the preferred form shown, the stator-coil unit forms a positioning groove. The end of the engaging portion extends into the positioning groove.

In the preferred form shown, the stator-coil unit comprises a shaft-coupling member, a silicon steel plate unit and a coil unit. The shaft-coupling member has one end being a fixed end. The fixed end is coupled with the engaging portion of the metal seat. The silicon steel plate unit is fit around the shaft-coupling member. The coil unit is formed by an enameled copper wire wound around a predetermined portion of the silicon steel plate unit.

In the preferred form shown, the positioning groove is formed between the fixed end of the shaft-coupling member and the silicon steel plate unit.

In the preferred form shown, the circuit board comprises at least one electrical contact. The coil unit comprises at least one electrical connection end electrically connected to the at least one electrical contact.

In the preferred form shown, the metal seat comprises a wire-positioning hole on the engaging face. A wire channel extends from the periphery of the metal seat to an edge of the wire-positioning hole. The circuit board comprises a lead wire. The lead wire has a first end electrically coupled to the circuit board. The lead wire has a second end passing through the wire-positioning hole and extending along the wire channel for connection to an external power source or a driving circuit.

In the preferred form shown, the circuit board further comprises an electrical connection port aligned with the wire channel.

In the preferred form shown, the lateral wall is a plastic material formed on the periphery of the metal seat by integral injection molding.

In the preferred form shown, the cooling fan further comprises a cover coupled with the lateral wall. The cover has a hole corresponding to the air inlet.

In the preferred form shown, the metal seat further comprises a plurality of vents.

Furthermore, an assembly method of a cooling fan is disclosed. The assembly method comprises providing a fan frame having a metal seat, providing a circuit board having a positioning hole and an insulation layer, and mounting the circuit board on the metal seat by fitting the circuit board around an engaging portion of the metal seat via the positioning hole. The insulation layer faces the metal seat. The assembly method further comprises mounting a stator-coil unit on the metal seat and electrically connecting the stator-coil unit to the circuit board. The assembly method further comprises rotatably coupling an impeller with the stator-coil unit.

In a preferred form shown, the assembly method further comprises providing a shaft-coupling member. A silicon steel plate unit that is wound with a coil unit is coupled with an outer circumferential face of the shaft-coupling member.

In the preferred form shown, the assembly method further comprises pulling an electrical connection end of the coil unit from the coil unit before the stator-coil unit is mounted on the metal seat, and electrically connecting the electrical connection end to the circuit board when the stator-coil unit is mounted on the metal seat.

In the preferred form shown, the assembly method further comprises pulling out at least one lead wire from the circuit board along a wire channel of the metal seat when the stator-coil unit is mounted on the metal seat, thereby connecting the lead wire to an external power source or a driving circuit.

In the preferred form shown, the assembly method further comprises electrically connecting a first end of the lead wire to an electrical connection port of the circuit board, and extending a second end of the lead wire to the outside via the wire channel when the electrical connection port is aligned with the wire channel.

Further, a cooling fan including a fan frame, a circuit board, a stator-coil unit and an impeller is disclosed in another embodiment of the invention. The fan frame comprises a metal seat and a lateral wall. The metal seat comprises an engaging face and an engaging portion arranged on the engaging face. The lateral wall is arranged on a periphery of the metal seat and defines an air inlet and an air outlet. The circuit board is adhered to the engaging face of the metal seat. The circuit board comprises an insulation layer facing the metal seat. The insulation layer is in the form of a film with adhesion and insulation functions. The stator-coil unit is coupled with the fan frame and electrically connected to the circuit board. The impeller is rotatably coupled with the stator-coil unit.

Still further, an assembly method of a cooling fan is disclosed. The assembly method comprises providing a fan frame having a metal seat, providing a circuit board having an insulation layer which is adhesive and insulating, and adhering the circuit board to the metal seat when the insulation layer faces the metal seat. The assembly method further comprises mounting a stator-coil unit on the metal seat and electrically connecting the stator-coil unit to the circuit board. The assembly method further comprises rotatably coupling an impeller with the stator-coil unit.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
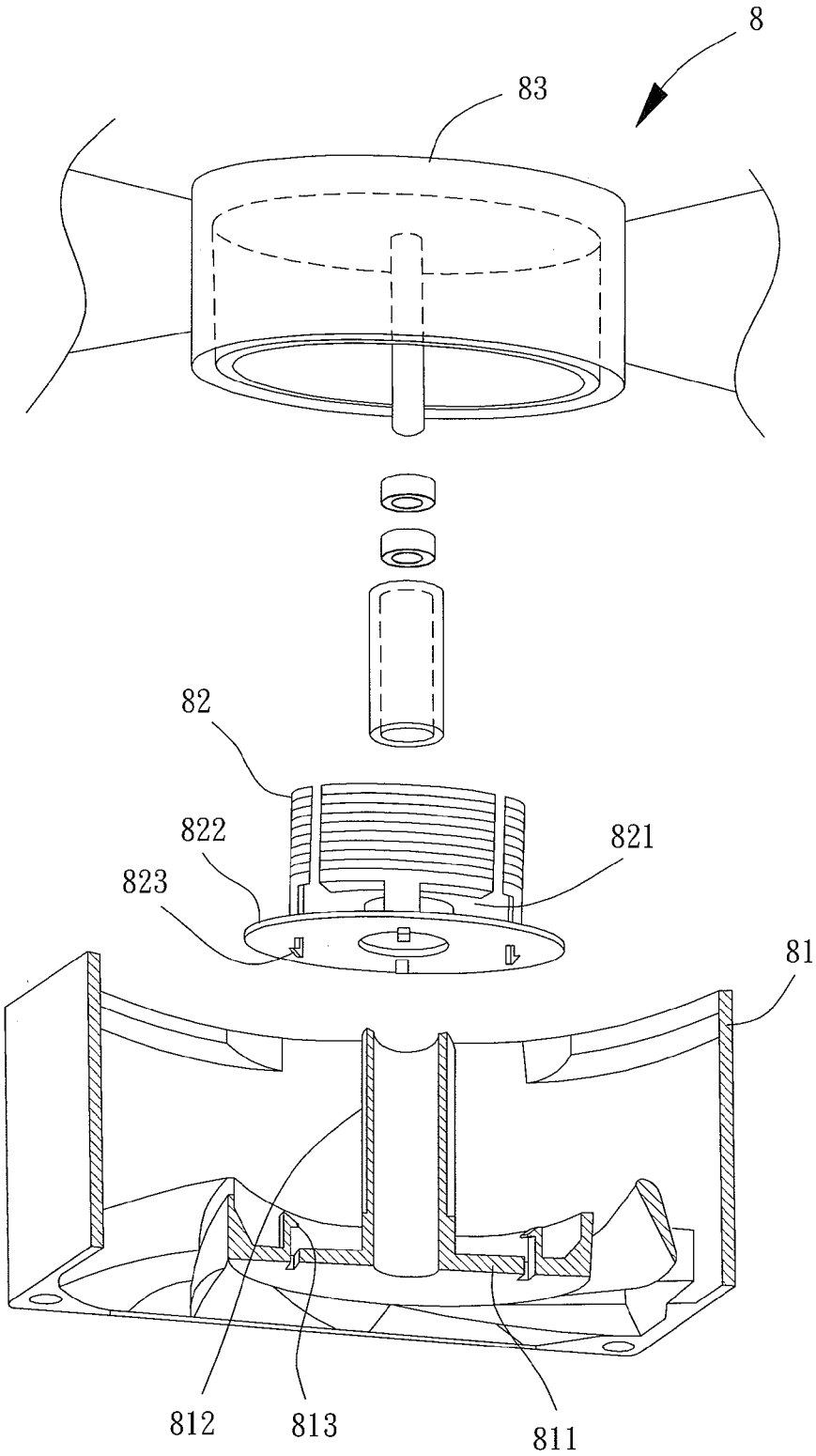
FIG. 1 PRIOR ART
FIG. 1 is an exploded view of a conventional cooling fan.
Figure 2:
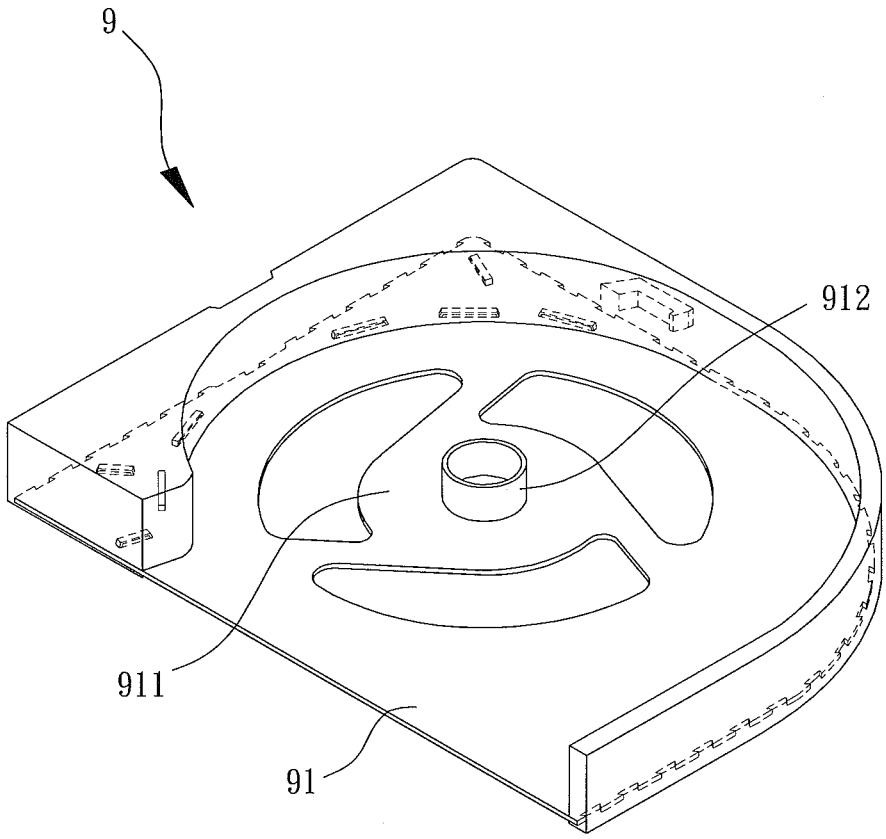
FIG. 2 PRIOR ART
FIG. 2 shows a conventional fan frame.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
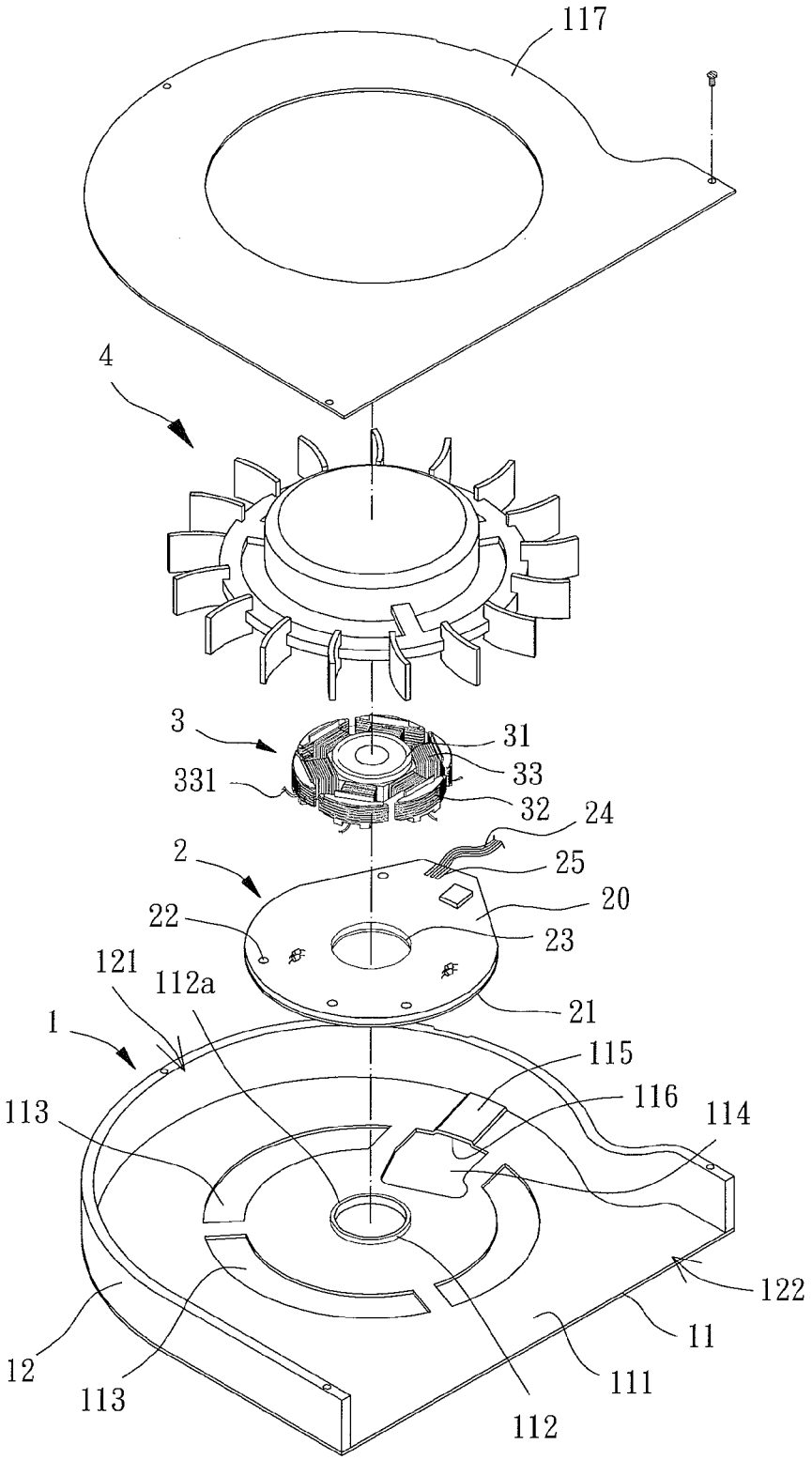
FIG. 3 is an exploded view of a cooling fan of the invention.

FIG. 3 shows a cooling fan including a fan frame 1, a circuit board 2, a stator-coil unit 3 and an impeller 4 according to a preferred embodiment of the invention. The circuit board 2 may be mounted in the fan frame 1 and is electrically connected to an external power source or a driving circuit. The impeller 4 is rotatably coupled with the stator-coil unit 3, so that the impeller 4 can be driven by the stator-coil unit 3.

The fan frame 1 includes a metal seat 11 and a lateral wall 12. The metal seat 11 includes an engaging face 111 and an engaging portion 112 mounted on the engaging face 111. The engaging portion 112 has one end 112*a* protruding from the engaging face 111. The engaging portion 112 may be a sleeve for coupling with the stator-coil unit 3. The lateral wall 12 is arranged on the periphery of the metal seat 11 and defines an air inlet 121 and an air outlet 122. The lateral wall 12 is preferably a plastic material formed on the periphery of the metal seat 11 by integral injection molding, thereby achieving convenient assembly and reducing the costs of the cooling fan.

The metal seat 11 may have a plurality of vents 113 to increase the quantity of air entering the fan frame 1. The metal seat 11 also includes a wire-positioning hole 114 on the engaging face 111. The metal seat 11 further includes a protrusion 115 extending from the periphery of the metal seat 11 to the edge of the wire-positioning hole 114. Thus, a wire channel 116 may be formed on the bottom face of the protrusion 115 for positioning the lead wire of the circuit board 2. A cover 117 may couple with the fan frame 1. Specifically, the cover 117 may couple with the top edge of the lateral wall 12. The cover 117 has a hole corresponding to the air inlet 121.

The circuit board 2 is adhered to the engaging face 111 of the metal seat 11. The circuit board 2 includes a base plate 20 and an insulation layer 21. The insulation layer 21 is arranged on one face of the metal seat 11 facing the metal seat 11. The insulation layer 21 is preferably in the form of a film with adhesion and insulation functions (such as a twin adhesive or resin) to firmly adhere the circuit board 2 to the engaging face 111 of the metal seat 11. The circuit board 2 includes at least one electrical contact 22 to which the stator-coil unit 3 is electrically connected.

The circuit board 2 further includes a positioning hole 23 extending through the base plate 20 and the insulation layer 21. The circuit board 2 is press fit around the engaging portion 112 of the metal seat 11 via the positioning hole 23. The end 112*a* of the engaging portion 112 can be forced through the positioning hole 23 to protrude from the circuit board 2, firmly mounting the stator-coil unit 3 on the engaging portion 112. The circuit board 2 may further include a lead wire 24 and an electrical connection port 25. The lead wire 24 has a first end electrically connected to the electrical connection port 25, as well as a second end passing through the wire-positioning hole 114. The lead wire 24 is connected to the external power source (or the driving circuit) via the wire channel 116. Thus, the lead wire 24 may be properly positioned in the wire channel 116, achieving convenient connection between the circuit board 2 and the external power source (or the driving circuit).

Figure 4:
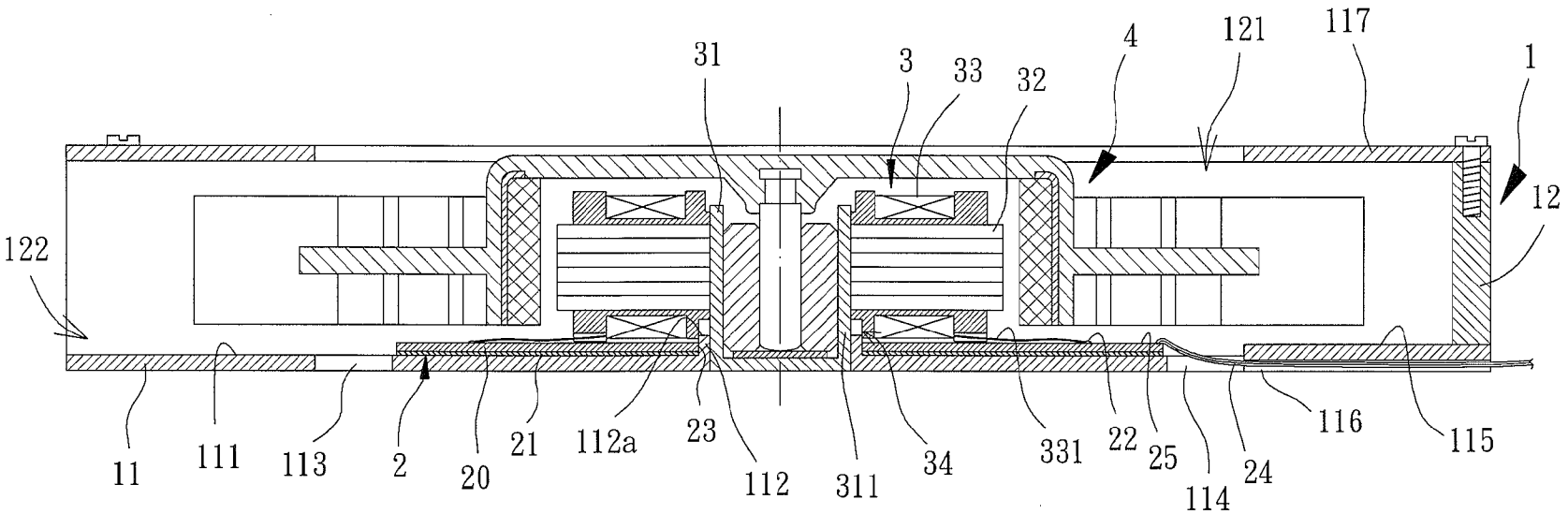
FIG. 4 is a cross-sectional view of the cooling fan of the invention.

The stator-coil unit 3 includes a shaft-coupling member 31, a silicon steel plate unit 32 and a coil unit 33. The shaft-coupling member 31 is any structure that can be rotatably coupled by the impeller 4, such as a shaft tube that receives a bearing. The shaft-coupling member 31 has one end being a fixed end 311, as shown in FIG. 4. The silicon steel plate unit 32 is fit around the shaft-coupling member 31. An enameled copper wire is wound around a predetermined portion of the silicon steel plate unit 32 to form the coil unit 33. The coil unit 33 has at least one electrical connection end 331 electrically connected to the at least one electrical contact 22 of the circuit board 2.

A positioning groove 34 is formed between the fixed end 311 of the shaft-coupling member 31 and the silicon steel plate unit 32, as shown in FIG. 4. Therefore, when the fixed end 311 of the shaft-coupling member 31 is coupled with the engaging portion 112 of the metal seat 11, the end 112*a* of the engaging portion 112 may be forced into the positioning groove 34. This firmly mounts the stator-coil unit 3 on the fan frame 1 to obtain reinforced coupling between the stator-coil unit 3 and the fan frame 1.

The impeller 4 is rotatably coupled with the shaft-coupling member 31 of the stator-coil unit 3. The impeller 4 has a shaft and a permanent magnet, with the shaft rotatably coupled with the shaft-coupling member 31. There is an air gap between the permanent magnet and the stator-coil unit 3. When the stator-coil unit 3 is electrically connected to the external power source (or the driving circuit), the stator-coil unit 3 generates magnetic fields that react with the permanent magnet through the air gap, driving the impeller 4 to rotate. Thus, a cooling effect is provided.

Figure 5:
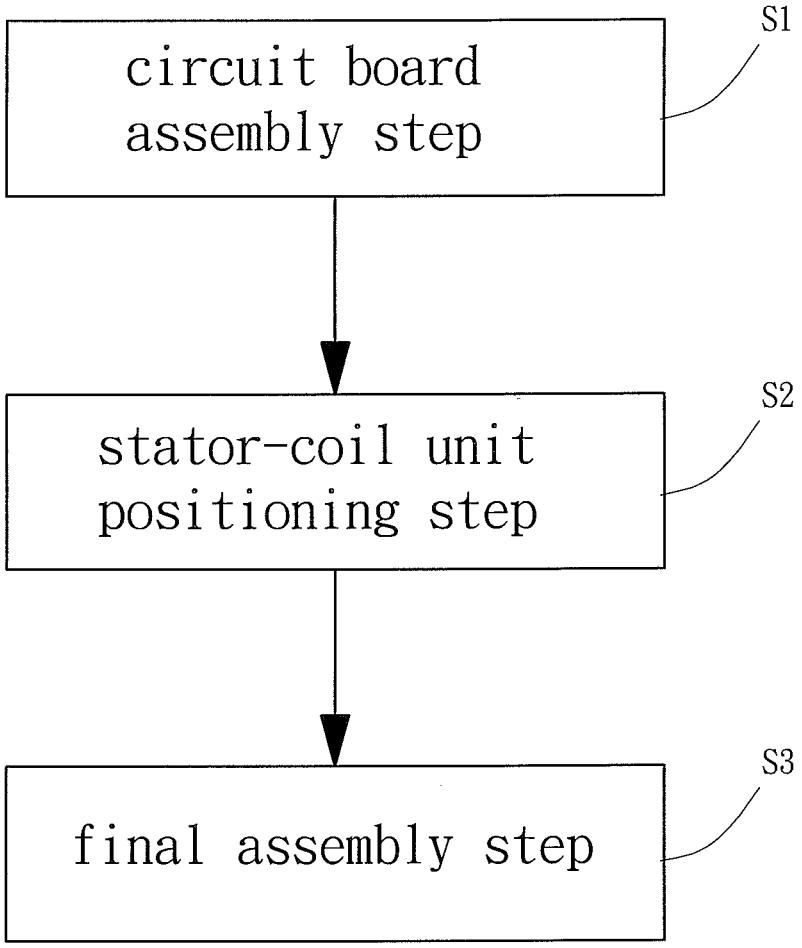
FIG. 5 shows a flowchart of an assembly method of a cooling fan according to the invention.

Referring to FIG. 5, an assembly method of the cooling fan includes a circuit board assembly step S1, a stator-coil unit positioning step S2 and a final assembly step S3.

Figure 6:
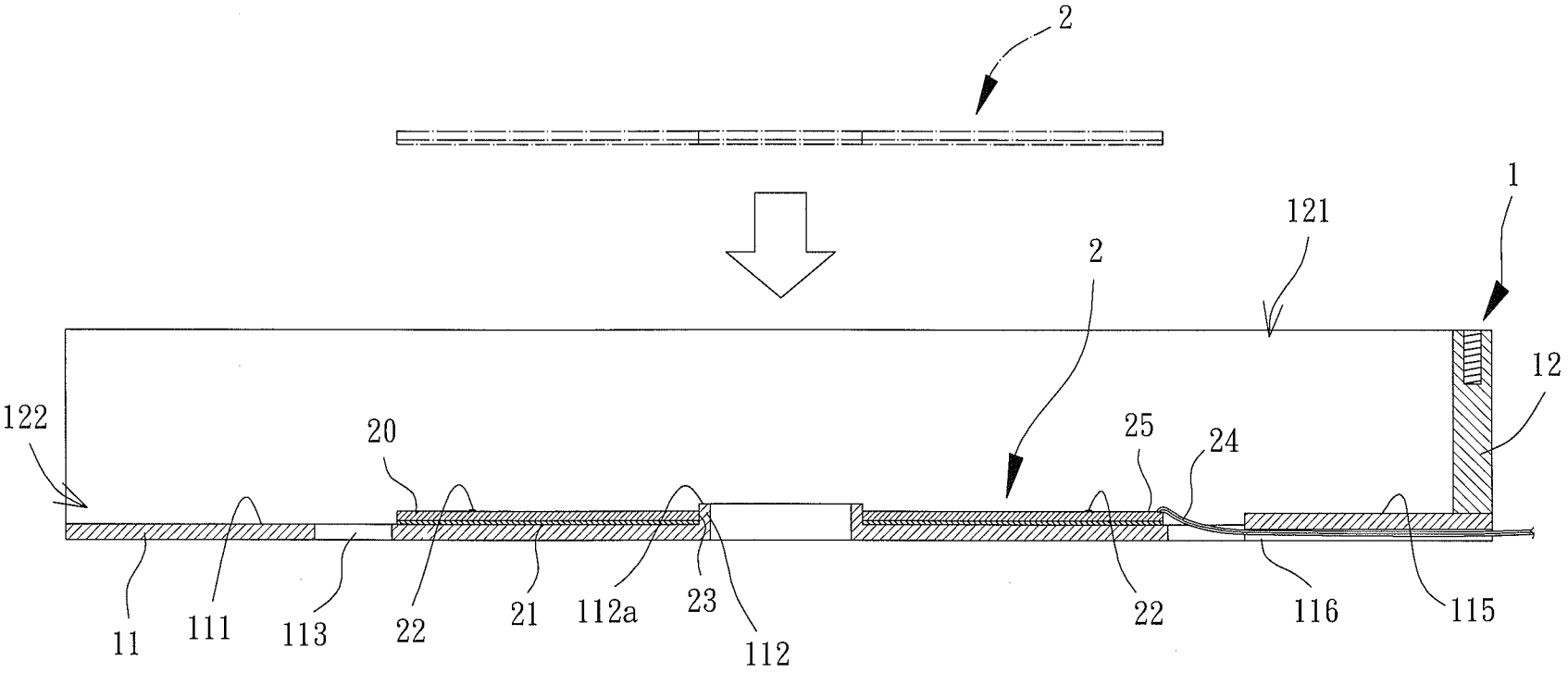
FIG. 6 shows a circuit board assembly step of the assembly method of the cooling fan according to the invention.

As shown in FIGS. 5 and 6, the circuit board assembly step S1 is configured to provide the fan frame 1 with the metal seat 11. The circuit board 2 may be press fit around the engaging portion 112 of the metal seat 11 via the positioning hole 23. Alternatively, the circuit board 2 may be adhered to the engaging face 111 of the metal seat 11. The circuit board 2 can be rapidly mounted on the metal seat 11 either way. If the circuit board 2 is adhered to the engaging face 111 of the metal seat 11 via the insulation layer 21, the insulation layer 21 may be arranged on the bottom face of the circuit board 2 before the circuit board 2 is adhered to the metal seat 11. Alternatively, the insulation layer 21 may also be arranged on the metal seat 11 before the circuit board 2 is adhered to the metal seat 11. Moreover, the circuit board assembly step S1 may be further configured to align the electrical connection port 25 of the circuit board 2 with the wire channel 116, and to pull the lead wire 24 along the wire channel 116 to be connected to the external power source (or the driving circuit).

Figure 7:
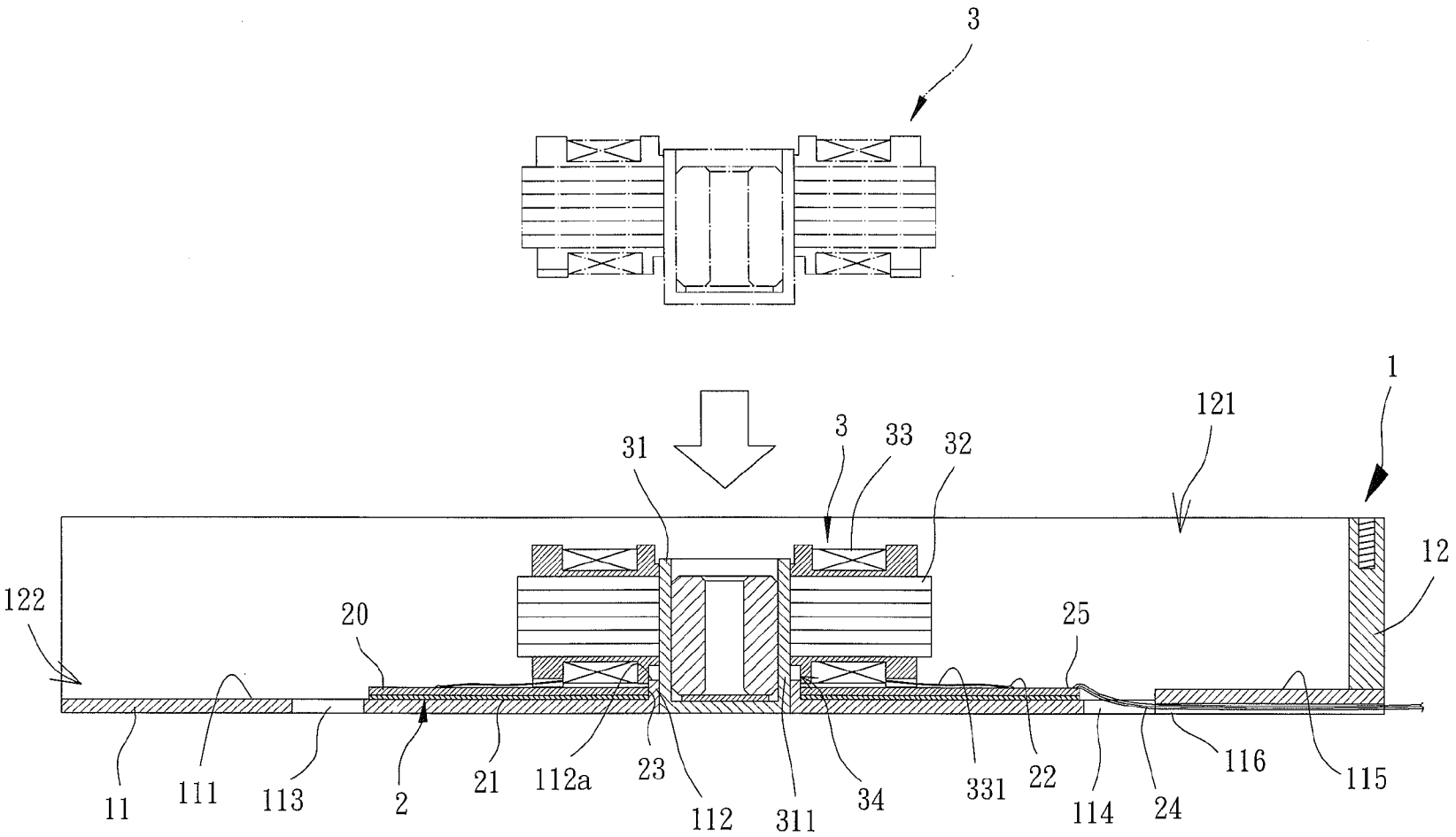
FIG. 7 shows a stator-coil unit positioning step of the assembly method of the cooling fan according to the invention.

Referring to FIGS. 5 and 7, the stator-coil unit positioning step S2 is configured to provide the shaft-coupling member 31, so that the silicon steel plate unit 32, which is wound with the coil unit 33, will be coupled with the outer circumferential face of the shaft-coupling member 31. Moreover, the electrical connection end 331 may be pulled out from the coil unit 33 in advance and kept aside for future connection to the electrical contact 22 of the circuit board 2. Finally, the stator-coil unit 3 consisting of the shaft-coupling member 31, the silicon steel plate unit 32 and the coil unit 33 is fit around the engaging portion 112 of the metal seat 11. At this time, the electrical connection end 331 can be electrically connected to the electrical contact 22 of the circuit board 2.

Figure 8:
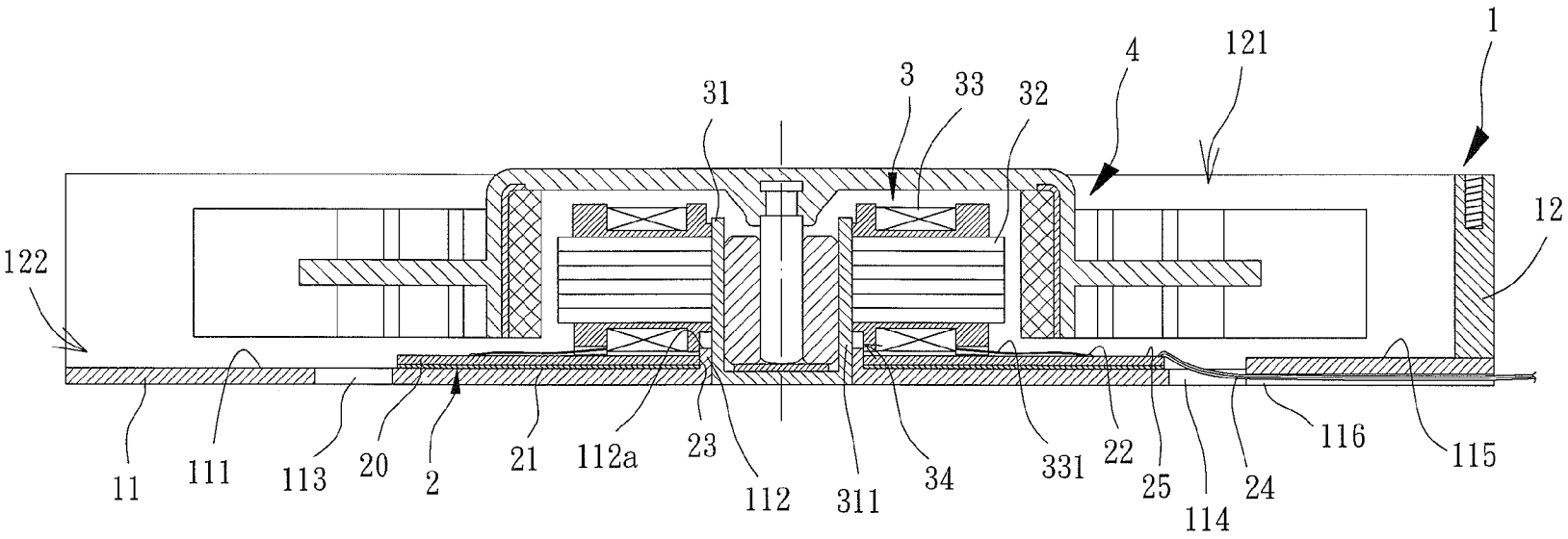
FIG. 8 shows a final assembly step of the assembly method of the cooling fan according to the invention.

Referring to FIGS. 5 and 8, the final assembly step S3 is configured to rotatably couple the impeller 4 with the shaft-coupling member 31 of the stator-coil unit 3. Then, the cover 117 is preferably fixed on the top edge of the lateral wall 12 to complete the assembly procedure of the cooling fan, as shown in FIG. 4.

The embodiments of the invention are able to achieve many advantages based on the disclosed structures of the cooling fan, as well as based on the assembly method of the cooling fan, as described in detail below.

In one embodiment of the invention, since the stator-coil unit 3 can be mounted on the metal seat 11 after the circuit board 2 is mounted on the metal seat 11, the cooling fan of the invention will have a simplified assembly procedure and a convenient assembly. In contrast, the conventional cooling fan 8 has a troublesome assembly procedure due to the fact that the circuit board 822 must be coupled with the stator 821 before the assembled stator 811 and circuit board 822 are mounted on the seat 811.

During the assembly process, since the circuit board 2 is mounted on the metal seat 11 in advance, the enameled copper wire of the electrical connection end 331 can be properly arranged in a manner that allows the electrical connection end 331 of the coil unit 33 to be easily connected to the electrical contact 22 of the circuit board 2 when the stator-coil unit 3 is mounted on the metal seat 11. Thus, the enameled copper wire will be arranged in convenience. The enameled copper wire will also be connected to the electrical contact 22 in convenience.

In the assembly method of the cooling fan, the lead wire 24 of the circuit board 2 is guided to the external power source (or the driving circuit) through the wire channel 116, rapidly arranging and positioning the lead wire 24.

In addition, one embodiment of the invention is able to provide improved insulation between the metal seat 11 and the circuit board 2 through the insulation layer 21 therebetween.

Furthermore, the circuit board 2 can be mounted on the engaging face 111 of the metal seat 11 when the circuit board 2 is press fit around the engaging portion 112 of the metal seat 11 via the positioning hole 23. Alternatively, when the circuit board 2 is adhered to the metal seat 11 via the insulation layer 21, the height of the cooling fan is reduced, and convenient assembly of the cooling fan is achieved.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A cooling fan comprising:

a fan frame comprising a metal seat and a lateral wall, wherein the metal seat comprises an engaging face, a bottom face opposite to the engaging face and an engaging portion arranged on the engaging face, wherein the lateral wall is arranged on a periphery of the metal seat and defines an air inlet and an air outlet, wherein the metal seat comprises a wire-positioning hole on the engaging face;

a circuit board comprising a periphery and a positioning hole, wherein the circuit board is press fit around the engaging portion of the metal seat via the positioning hole and adhered to the engaging face of the metal seat, wherein the circuit board comprises an insulation layer facing the metal seat;

a stator-coil unit mounted on the metal seat of the fan frame and electrically connected to the circuit board; and an impeller rotatably coupled with the stator-coil unit, wherein a wire channel is formed on the bottom face and extends radially from the periphery of the metal seat to an edge of the wire-positioning hole, wherein the edge of the wire-positioning hole is located radially intermediate the peripheries of the circuit board and the metal seat, wherein the circuit board comprises a lead wire, wherein the lead wire has a first end electrically coupled to the circuit board, wherein the lead wire has a second end passing through the wire-positioning hole and extending radially along and in the wire channel for connection to an external power source or a driving circuit, and wherein the metal seat is located intermediate the impeller and the lead wire in the wire channel.

2. The cooling fan as claimed in claim 1, wherein the engaging portion has one end protruding from the engaging face of the metal seat, and wherein the end of the engaging portion is adapted to be coupled with the stator-coil unit.

3. The cooling fan as claimed in claim 2, wherein the end of the engaging portion extends through the positioning hole of the circuit board, and wherein the end of the engaging portion protrudes from the circuit board.

4. The cooling fan as claimed in claim 3, wherein the stator-coil unit forms a positioning groove, and wherein the end of the engaging portion extends into the positioning groove.

5. The cooling fan as claimed in claim 4, wherein the stator-coil unit comprises a shaft-coupling member, a silicon steel plate unit and a coil unit, wherein the shaft-coupling member has one end being a fixed end, wherein the fixed end is coupled with the engaging portion of the metal seat, wherein the silicon steel plate unit is fit around the shaft-coupling member, and wherein the coil unit is formed by an enameled copper wire wound around a predetermined portion of the silicon steel plate unit.

6. The cooling fan as claimed in claim 5, wherein the positioning groove is formed between the fixed end of the shaft-coupling member and the silicon steel plate unit.

7. The cooling fan as claimed in claim 5, wherein the circuit board comprises at least one electrical contact, and wherein the coil unit comprises at least one electrical connection end electrically connected to the at least one electrical contact.

8. The cooling fan as claimed in claim 1, wherein the circuit board further comprises an electrical connection port aligned with the wire channel.

9. The cooling fan as claimed in claim 1, wherein the lateral wall is a plastic material integrally formed on the periphery of the metal seat by integral injection molding.

10. The cooling fan as claimed in claim 1, further comprising a cover coupled with the lateral wall, wherein the cover has a hole corresponding to the air inlet.

11. The cooling fan as claimed in claim 1, wherein the metal seat further comprises a plurality of vents located intermediate the peripheries of the circuit board and the metal seat.

12. A cooling fan comprising:

a fan frame comprising a metal seat and a lateral wall, wherein the metal seat comprises an engaging face, a bottom face opposite to the engaging face, and an engaging portion arranged on the engaging face, wherein the lateral wall is arranged on a periphery of the metal seat and defines an air inlet and an air outlet, wherein the metal seat comprises a wire-positioning hole on the engaging face;

a circuit board adhered to the engaging face of the metal seat, wherein the circuit board comprises a periphery and an insulation layer facing the metal seat, wherein the insulation layer is in the form of a film with adhesion and insulation functions;

a stator-coil unit coupled with the fan frame and electrically connected to the circuit board; and an impeller rotatably coupled with the stator-coil unit, wherein a wire channel is formed on the bottom face extends radially from the periphery of the metal seat to an edge of the wire-positioning hole, wherein the edge of the wire-positioning hole is located radially intermediate the peripheries of the circuit board and the metal seat, wherein the circuit board comprises a lead wire, wherein the lead wire has a first end electrically coupled to the circuit board, and wherein the lead wire has a second end passing through the wire-positioning hole and extending radially along and in the wire channel for connection to an external power source or a driving circuit, and wherein the metal seat is located intermediate the impeller and the lead wire in the wire channel.

13. The cooling fan as claimed in claim 12, wherein the engaging portion has one end protruding from the engaging face of the metal seat, and wherein the end of the engaging portion is adapted to be coupled with the stator-coil unit.

14. The cooling fan as claimed in claim 13, wherein the circuit board has a positioning hole, wherein the end of the engaging portion extends through the positioning hole of the circuit board, and wherein the end of the engaging portion protrudes from the circuit board.

15. The cooling fan as claimed in claim 14, wherein the stator-coil unit forms a positioning groove, and wherein the end of the engaging portion extends into the positioning groove.

16. The cooling fan as claimed in claim 15, wherein the stator-coil unit comprises a shaft-coupling member, a silicon steel plate unit and a coil unit, wherein the shaft-coupling member has one end being a fixed end, wherein the fixed end is coupled with the engaging portion of the metal seat, wherein the silicon steel plate unit is fit around the shaft-coupling member, and wherein the coil unit is formed by an enameled copper wire wound around a predetermined portion of the silicon steel plate unit.

17. The cooling fan as claimed in claim 16, wherein the positioning groove is formed between the fixed end of the shaft-coupling member and the silicon steel plate unit.

18. The cooling fan as claimed in claim 16, wherein the circuit board comprises at least one electrical contact, and wherein the coil unit comprises at least one electrical connection end electrically connected to the at least one electrical contact.

19. The cooling fan as claimed in claim 12, wherein the circuit board further comprises an electrical connection port aligned with the wire channel.

20. The cooling fan as claimed in claim 12, wherein the lateral wall is a plastic material integrally formed on the periphery of the metal seat by integral injection molding.

21. The cooling fan as claimed in claim 12, further comprising a cover coupled with the lateral wall, wherein the cover has a hole corresponding to the air inlet.

22. The cooling fan as claimed in claim 12, wherein the metal seat further comprises a plurality of vents located intermediate the peripheries of the circuit board and the metal seat.

23. An assembly method of a cooling fan comprising:

providing a fan frame having a metal seat comprising an engaging face and a bottom face opposite to the engaging face;

providing a circuit board having a positioning hole and an insulation layer;

adhering the circuit board to the metal seat by fitting the circuit board around an engaging portion arranged on the engaging face of the metal seat via the positioning hole when the insulation layer faces the metal seat;

pulling out at least one lead wire from the circuit board via a wire channel formed on the bottom face of the metal seat when the stator-coil unit is mounted on the metal seat, thereby connecting the wire to an external power source or a driving circuit;

mounting a stator-coil unit on the metal seat and electrically connecting the stator-coil unit to the circuit board; and rotatably coupling an impeller with the stator-coil unit with the metal seat being intermediate the impeller and the lead wire in the wire channel.

24. The assembly method of the cooling fan as claimed in claim 23, further comprising: providing a shaft-coupling member, wherein a silicon steel plate unit that is wound with a coil unit is coupled with an outer circumferential face of the shaft-coupling member.

25. The assembly method of the cooling fan as claimed in claim 24, further comprising: pulling an electrical connection end of the coil unit from the coil unit before the stator-coil unit is mounted on the metal seat, and electrically connecting the electrical connection end to the circuit board when the stator-coil unit is mounted on the metal seat.

26. The assembly method of the cooling fan as claimed in claim 23, further comprising: electrically connecting a first end of the lead wire to an electrical connection port of the circuit board, and extending a second end of the lead wire to outside the fan frame via the wire channel when the electrical connection port is aligned with the wire channel.

27. An assembly method of a cooling fan comprising:

providing a fan frame having a metal seat comprising an engaging face and a bottom face opposite to the engaging face;

providing a circuit board having an insulation layer being adhesive and insulating;

adhering the circuit board to the engaging face of the metal seat when the insulation layer faces the metal seat;

pulling out at least one lead wire from the circuit board along a wire channel formed on the bottom face of the metal seat when the stator-coil unit is mounted on the metal seat, thereby connecting the lead wire to an external power source or a driving circuit;

mounting a stator-coil unit on the metal seat and electrically connecting the stator-coil unit to the circuit board; and rotatable coupling an impeller with the stator-coil unit, with the metal seat being intermediate the impeller and the lead wire in the wire channel.

28. The assembly method of the cooling fan as claimed in claim 27, wherein the circuit board is adhered to the metal seat after the insulation layer is arranged on a bottom face of the circuit board.

29. The assembly method of the cooling fan as claimed in claim 27, wherein the circuit board is adhered to the metal seat after the insulation layer is arranged on the metal seat.

30. The assembly method of the cooling fan as claimed in claim 27, further comprising: providing a shaft-coupling member, wherein a silicon steel plate unit that is wound with a coil unit is coupled with an outer circumferential face of the shaft-coupling member.

31. The assembly method of the cooling fan as claimed in claim 30, further comprising: pulling an electrical connection end of the coil unit from the coil unit before the stator-coil unit is mounted on the metal seat, and electrically connecting the electrical connection end to the circuit board when the stator-coil unit is mounted on the metal seat.

32. The assembly method of the cooling fan as claimed in claim 27, further comprising: electrically connecting a first end of the lead wire to an electrical connection port of the circuit board, and extending a second end of the lead wire to outside the fan frame via the wire channel when the electrical connection port is aligned with the wire channel.

* * * * *